United States Patent [19]

Oppitz et al.

[11] 4,451,263

[45] May 29, 1984

[54] PROCESS FOR DYEING AND FINISHING TUBULAR TEXTILE MATERIAL: ALIGNMENT OF FLATTENED EDGES DISPLACED TO AVOID EDGE MARKINGS

[75] Inventors: Peter Oppitz, Kelkheim; Manfred Schulze-Braucks, Hofheim am Taunus; Rolf Tesche, Glashütten, all of Fed. Rep. of Germany

[73] Assignee: Hoechst Aktiengesellschaft, Frankfurt am Main, Fed. Rep. of Germany

[21] Appl. No.: 443,675

[22] Filed: Nov. 22, 1982

[30] Foreign Application Priority Data

Nov. 24, 1981 [DE] Fed. Rep. of Germany ..... 3146431

[51] Int. Cl.[3] ..... D06B 1/10; D06B 3/18; D06B 15/02

[52] U.S. Cl. ..... 8/500; 8/151; 8/932; 68/99

[58] Field of Search ..... 8/500, 151

[56] References Cited

U.S. PATENT DOCUMENTS 3,958,432 5/1976 Aronoff ..... 68/13 R 4,226,598 10/1980 Schiffer ..... 8/125

4,304,567 12/1981 Ballman et al. ..... 8/543

4,322,957 4/1982 Nowicki et al. ..... 68/13 R

FOREIGN PATENT DOCUMENTS 811369 4/1959 United Kingdom .

*Primary Examiner*—A. Lionel Clingman

*Attorney, Agent, or Firm*—Curtis, Morris & Safford

[57] ABSTRACT

The very economical padding methods for applying liquid treatment agents and which have largely become established for flat-lying material are also interesting for dyeing and finishing tubular textile material. In the latter case, the use of this technique is however opposed by the finding that on impregnating circular-knitted goods on a pad mangle the squeeze edges are marked on both sides of the tube, which gives rise, for example, to undesirable color differences. According to the invention, this adverse phenomenon and the problems arising therefrom can be avoided if, through maintaining a relatively high liquor pick-up by the textile material and through mechanical shifting of the edges, the liquor is enabled to level out any unevenness produced on squeezing.

10 Claims, No Drawings

PROCESS FOR DYEING AND FINISHING TUBULAR TEXTILE MATERIAL: ALIGNMENT OF FLATTENED EDGES DISPLACED TO AVOID EDGE MARKINGS

The present invention relates to a process for uniformly applying a liquor containing the treatment agent when dyeing and/or finishing tubular textile material by padding and squeezing off excess liquor on a pad mangle.

Such processes for applying liquor are sufficiently well-known for single-layer textiles, and are practised on an industrial scale. Their great economy makes these processes also interesting for wet-treating tubular textile material. Now, since a fabric web in the form of an open sheet structure has selvedges at both edges, it is stable to all finishing processes. In contrast, fabrics woven or knitted on circular machines are seamless, and as flexible tubular bodies they are a relatively unstable meshed structure which is very sensitive to tensile stress. While the transport of goods in rope form does not in general present problems, guiding a spread-out tube must be handled with appropriate care.

However, transporting the goods while preserving the quality of the material as part of a continuous application method by padding presents a serious processing problem in that the unslit tube of material when spread out consists of two layers of fabric which are connected to each other only at the reversing points. There at the two edges, where the bottom layer of the tube makes a 180° turn and becomes the top layer, this turning point creates different spatial conditions in respect of mesh structure and thus capillary conditions which differ from those of the flat-lying parts of the tube. Due to these circumstances, the pressure in the nip of the pad mangle bowls, when impregnating the goods, has a different effect at the relevant points, which is why the tube is squeezed qualitatively differently at the edges than in the other parts. This result leads to the occurrence of so-called squeeze edges and is due to the fact that in these areas the material contains less liquor than in the double layer. This edge formation thus caused is then, if there is no equalizing, marked on the goods in the form of longitudinal stripes, which manifests itself, for example, after a dyeing has been finished in marked color differences compared with the rest of the tube.

Repeated efforts have therefore already been made in practice to remedy this unfortunate state of affairs with regard to levelness in the finished goods:

Thus, for example, it has already been tried, in German Pat. No. 1,769,863, when dyeing tubular cellulose fiber articles with reactive dyestuffs using the one-bath pad wet-steam method, to obviate undesirable edge formation by using pad mangles where the bowls are covered with material of a certain Shore hardness and maintaining selected conditions for fixing dyestuff.

Other application development work aimed at eliminating the danger of marking by squeeze edges was concerned with improving the migration conditions within the tube by increasing the liquor pick-up on padding and to bring about the necessary leveling between the areas with differing squeeze effect.

Most measures of this type had the object again of removing, or preventing formation of, the unlevelness resulting over the entire length of the treated tube of fabric due to the squeeze edges by modifying the liquor by, for example, adding auxiliaries. For example, German Offenlegungsschrift No. 2,918,607 reports on this point in connection with the dyeing of cellulose textiles with reactive dyestuffs using the cold batch process.

The entire problem area is also surveyed in Melliand Textilberichte 4/1979, pages 341 et seq. However, previous attempts to remedy the problems occurring in connection with the squeeze edge phenomenon were only partially successful. On the other hand, the energy crisis increasingly intensifies the demand for an energy-saving simple technique.

It is, then, the object of the present invention to develop an improved method for the application of liquor in the wet treatment, such as, for example, dyeing and/or finishing, or tubular textile material without the edges of the tube being marked or the goods being stretched in longitudinal direction when the fiber material is padded on a pad mangle.

This object is achieved according to the invention if the moist fabric tube impregnated with the treatment liquor and spread out is squeezed to give a liquor pick-up of at least 60% (relative to the weight of the dry goods), and immediately thereafter the squeeze edges produced during this step at the two side edges of the tube by the pressure of the pad mangle bowls are moved in such a way with the assistance of mechanical means out of their position brought about in the nip so that they end up lying in that part of the fabric tube which runs flat and in two layers, and the tubular textile material thus treated is given sufficient time in the altered position, by batching, to level out the liquor over the goods by means of capillary migration.

In carrying out the present invention, the principle of giving the applied liquor the chance of remedying unlevelness produced in the course of the squeezing operation is made use of by maintaining a relatively high liquor pick-up by the tubular textile material, combined with a displacement of the edges. It can be assumed that the edges still unevenly impregnated after the padding are leveled out by the diffusion and migrating capacity during their batching. This method enables the undesirable marking of the squeeze edges to be eliminated.

There have been prejudices against the realizability of such a process, in particular in that up to now it had been assumed that due to the change in structure brought about by the machine engagement a mechanical shifting of the squeeze edges would again produce unlevelness in the finished goods, just as it could not be excluded that storage of the goods during batching would lead to the formation of edges at the freshly formed but unsqueezed side edges of the tube. However, such fears have surprisingly not been confirmed, owing to the measures according to the invention.

As already explained above, the liquor pick-up in the process has a considerable effect on the appearance of the goods. The edge formation tendency decreases with increasing liquor pick-up. After the fabric has been impregnated, excess liquor is removed via relatively soft squeezing rollers. Good results are obtained in the case of hydrophilic fiber textile material with a liquor pick-up of greater than 80% (relative to the dry weight), and in the case of hydrophobic fibers already at a liquor pick-up of greater than 60% (relative to the dry weight).

According to the invention, the edges of tubular textile material impregnated in the course of a liquor application operation by padding on a pad mangle and squeezed in the spread-out state are regulated, for example, via a special device, to which the present invention also relates. This edge shifting of the squeezed fabric tube is achieved most simply after the exit from the pair of bowls of the pad mangle by guiding the textile material over two expanders which are rotated against each other by a certain angle and of which the first is mounted in such a way that it spreads out again the squeeze edges produced while the second expander brings about the actual shifting of the squeeze edges. Under certain circumstances, a single expander rotated (inclined) against the nip of the pad mangle bowls may already be sufficient to accomplish the squeeze edge shift. The angle of rotation in the two arrangements explained above should be at least 10°; it is in general between 10° and 90°. For the purposes of the invention it is completely sufficient if the squeeze edges are shifted by about 2 cm.

To effect the abovementioned edge-shifting measures, how the expanders are constructed is completely open. Conveniently, known types are used which, for the purposes of the present invention, are mounted in characteristic fashion. They can be inside expanders as well as those types which act from the inside to the outside or even mechanisms which engage the running fabric tube solely from the outside. Whether the action is purely mechanical or magnetomechanical is just as immaterial provided only a reliable shift of the edges by a minimum amount is ensured.

A skew device which pulls the fabric in an oblique direction can be just as suitable for carrying out the edge shift.

According to the process it is also possible to effect an edge shift by blowing up the fabric tube with a gas, preferably air, followed by re-expanding the textile material with edges shifted from their previous position, provided it is certain that the blowing-up step itself does not cause undesirable liquor migration.

For the batching step, the fabric tube which is impregnated with the treatment agent and still moist is either plaited or wound onto rotatable rollers after the edge-shifting measures. To bring about adequate liquor leveling through capillary migration, the batching time in the process according to the invention is generally chosen in such a way that it amounts to at least 1 hour at room temperature after the edge shift. These batching times can advantageously be included in the fixing process for a permanent treatment agent applied to the fiber, provided the nature of the treatment agent allows corresponding fixing conditions to be contemplated.

Accordingly, the process according to the invention is carried out as follows: on a pad mangle, the textile tube is dipped at a temperature between about 5° and 40° C. into a padding liquor which contains a dissolved or dispersed treatment agent and squeezed off, the edge shift is carried out immediately after the fabric has left the nip of the pad mangle, and the goods are then batched, and the batching time can already be used, for example, to fix dyestuff or allow finishing agents to act. The dyeing or finish is then as a rule and as customary fixed and aftertreated.

It is of course also possible to combine the measures of the invention with already known means (such as, for example, of German Offenlegungsschrift No. 2,918,607) for eliminating squeeze edges, where, in this case, the padding liquor recipes need not be changed by much.

Suitable textile materials in welt form for the process according to the invention are woven and knitted fabrics where levelness is particularly important and which primarily consist of or contain cellulose fibers.

The wet treatment operation for applying liquor by padding can embrace, as already mentioned, a dyeing and/or finishing process. Such a textile finishing process through dyeing will advantageously use, for example, the semi-continuous pad cold-batch method with reactive dyestuffs, which, in respect of the necessary treatment steps, must be considered as an optimal method for utilizing the subject of the present invention, because the measures to remedy or prevent squeeze edges and the dyestuff fixation in the final process stage coincide.

All application principles for the cold-batch method with reactive dyestuffs on cellulose fibers, such as dyestuff selection, padding-liquor temperature, type and amount of alkali, if appropriate wetting agent, and the batching time remain unchanged, just like the aftertreatment operations.

In this process, other measures, such as, for example, reducing the amount of alkali when dyeing with reactive dyestuffs, can also be allowed for. The batching times to be maintained in this case then depend on the fixing temperature and can be shortened for 1 hour at room temperature to 10 minutes at 70° C.

When reactive dyestuffs are used on cellulose, the dyestuffs can however also be fixed on the padded moist goods using the one-bath pad wet-steam method.

We claim:

1. A process for uniformly applying a liquor containing a treatment agent when dyeing and/or finishing textile material in the form of a fabric tube by padding and squeezing off excess liquor on a pad mangle, comprising impregnating the fabric tube with the treatment liquor, spreading out the treated fabric tube in the moist state, squeezing the spread out moist fabric tube on the pad mangle to achieve a liquor pick-up of at least 60% relative to the dry weight of the fabric tube, resulting in forming squeeze edges on opposite side edges of the spread out, squeezed fabric tube, immediately thereafter moving the fabric tube so that the positions of the squeeze edges are displaced from their initial positions so that they lie in that part of the fabric tube which runs flat, and batching the textile material thus treated for sufficient time in its displaced position to level out the liquor over the entire fabric tube by capillary action.

2. The process as claimed in claim 1, wherein hydrophilic fiber textile material is squeezed to give a liquor pick-up of more than 80% (relative to the weight of the dry goods).

3. The process as claimed in claim 1, wherein hydrophobic fiber textile material is squeezed to give a liquor pick-up of more than 60% (relative to the weight of the dry goods).

4. The process as claimed in claim 1, wherein the edge shift after leaving the pad mangle is brought about by guiding the fabric tube over two expanders inclined against each other by an angle of at least 10° or over one expander inclined against the nip by an angle of at least 10 °.

5. The process as claimed in claim 4, wherein the edge shift is brought about by mechanisms engaging the running fabric tube from inside the tube.

6. The process as claimed in claim 4, wherein the edge shift is brought about by mechanisms engaging the running fabric tube from outside the tube.

7. The process as claimed in claim 4, wherein magnetically acting expanders are used.

8. The process as claimed in claim 1, wherein the edge shift is brought about by a diagonal traction mechanism.

9. The process as claimed in claim 1, wherein the edge shift is brought about by inflating the textile tube with a gas and then re-expanding the goods with the edges shifted from their previous position.

10. The process as claimed in claim 1, wherein the batching time at room temperature after the edge shift is at least 1 hour.

* * * * *